United States Patent [19]

Hamaguchi et al.

[11] 4,076,409

[45] * Feb. 28, 1978

[54] BELT TYPE SENSITIVE MEMBER UNIT

[75] Inventors: Hiroshi Hamaguchi, Sakai; Shin Miyata, Toyokawa, both of Japan

[73] Assignee: Minolta Camera Kabushiki Kaisha, Osaka, Japan

[ * ] Notice: The portion of the term of this patent subsequent to May 25, 1993, has been disclaimed.

[21] Appl. No.: 681,989

[22] Filed: Apr. 30, 1976

Related U.S. Application Data

[63] Continuation of Ser. No. 553,841, Feb. 27, 1975, Pat. No. 3,958,879.

[30] Foreign Application Priority Data

Mar. 7, 1974 Japan ..... 49-27093

[51] Int. Cl.[2] ..... G03G 15/00

[52] U.S. Cl. ..... 355/16; 312/349; 355/133

[58] Field of Search ..... 355/16, 3 R, 3 BE, 133; 198/184, 126; 312/341, 344, 349; 308/3.6, 3.8

[56] References Cited

U.S. PATENT DOCUMENTS

| | | | |
|---|---|---|---|
| Re. 27,776 | 10/1973 | Turner | 355/16 |
| 3,520,604 | 7/1970 | Shelffo | 355/16 |
| 3,604,797 | 9/1971 | Szezesniak | 355/16 |
| 3,679,275 | 7/1972 | Fall et al. | 312/341 NR |
| 3,796,488 | 3/1974 | Tanaka et al. | 355/16 |
| 3,927,918 | 12/1975 | Dobbratz | 312/341 NR |

*Primary Examiner*—Richard L. Moses
*Attorney, Agent, or Firm*—Wolder & Gross

[57] ABSTRACT

An endless photosensitive belt assembly unit or "module" in a reproducing apparatus is supported near all four corners on slide rails for displacement to a position outside the apparatus. To give ready access to the photosensitive belt when the unit is in its outer position, the unit is pivotally mounted on the slide rails.

11 Claims, 5 Drawing Figures

BELT TYPE SENSITIVE MEMBER UNIT

This is a continuation, of application Ser. No. 553841, now U.S. Pat. No. 3,958,879 filed Feb. 27, 1975.

BACKGROUND OF THE INVENTION

1. Field of the Invention

This invention relates to an endless belt-type sensitive member assembly unit or "module", and more particularly to one where an endless belt-type sensitive member is trained in tension about a plurality of supporting rollers mounted between the side frames of the unit.

2. Discussion of the Prior Art

In a high speed electrophotographic reproducing apparatus which has an endless belt-type photosensitive member and in which an instantaneous exposure is effected by means of a flash lamp, it is required to transport the photosensitive member, i.e., the belt, in a flat or tensioned condition at the moment of exposure, so that the image of an original document may be projected onto the photosensitive member — or "belt" as it will be referred to hereafter — in a satisfactory manner. To this end, the unit in which the sensitive member or "belt" is mounted is so constructed that part of the belt, i.e., at least the portion thereof to be exposed to the light image, is usually maintained flat. In addition, because the exposure is instantaneously effected by means of a flash lamp, the belt travels continuously from the exposure station to the developing station, transfer station, etc. without interruption of motion at every exposure.

The belt on the sensitive member assembly unit or "module", as it will be called hereinafter, should travel to the successive stations of the above-mentioned series in a manner that respective corresponding portions of the belt are positioned properly at the related stations, and accordingly there should be provided a special belt-type sensitive member to meet this end in connection with its usage.

Hitherto, a seamless endless belt-type sensitive member has been used, generally being trained in tension about supporting rollers mounted in the module, with at least the portion thereof to be exposed to the light image being maintained in a flat state, as mentioned above. The sensitive member of this type is repeatedly used for reproducing an original document, such that its service life is only about 5,000 to 10,000 reproduction cycles, resulting in the necessity to replace it frequently. Furthermore, for removing a sheet of copying paper stuck in the reproducing apparatus, for removing stains such as toner residues from the belt surface, or for removing dust adhering to the belt surface, the module must be taken out from the main body of the reproducing apparatus where it rests during operation. A sensitive member to be set on the module is of an endless type, hence for facilitating its replacement, all support must be provided within the module, rather than outwardly of its periphery, so as not to interfere with resetting of the endless belt into the unit. As shown in FIG. 1, the construction of a known unit is, for example, such that guide rails C along which a module A is withdrawn from the main body of a reproducing apparatus, are provided within module A, while rails B provided within the reproducing apparatus extend into the interior of A in engaging relation to the aforesaid guide rails C. The rails B are therefore necessarily of a cantilever type supported at only one point D by the reproducing apparatus. For proper support of the heavy module A by the cantilevered rails B, an extremely strong reinforcing member must be provided at the point D where the load is concentrated. Because rails B are supported only at one end, i.e., at point D, the rails B and C become deflected due to the weight of module A during the repeated cycles of withdrawal and reinsertion of module A from and into, respectively, the reproducing apparatus. This deflection results in inaccurate positioning of the exposure, developing, transfer and cleaning stations relative to the belt or sensitive member trained in tension around module A. Inaccurate positioning adversely affects the reproducing function of the apparatus itself, resulting in a poor quality image, such as a defocused or an unevenly developed image.

SUMMARY OF THE INVENTION

The invention resides in an improved belt-type photosensitive member unit for use in an electrophotographic reproducing apparatus having a main body portion, the unit including a plurality of rollers rotatably confined between a pair of side frames, an endless belt-type sensitive member being trained about the plurality of rollers for mounting, the rollers comprising a drive roller and a roller provided with a member for adjusting the tension of the endless belt-type sensitive member. The improvement in the unit comprises two pairs of rails each rigidly supported at two points on support members provided within the main body of the reproducing apparatus; two pairs of rails fixed to the unit outwardly thereof and adapted to cooperate with the first-mentioned pairs of rails to permit the unit to slide therealong; reinforcing rails disposed between the first-mentioned pairs of rails and the second-mentioned pairs of rails in a manner to be slidable to a given position on the first-mentioned pairs of rails, together with the sensitive member unit when same is withdrawn from or returned into the interior of the reproducing apparatus; and the unit being pivotally mounted on the second-mentioned one of the pairs of rails such that the unit can be moved away from the second-mentioned rails to provide an opening for access to the endless belt.

DESCRIPTION OF THE PREFERRED EMBODIMENT

Figure 1:
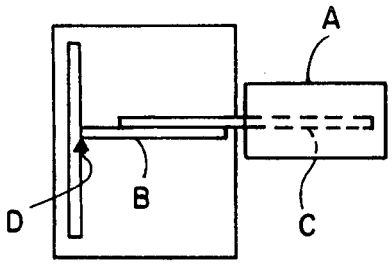
FIG. 1 schematically shows the outline of the sensitive member support means of a conventional unit.
Figure 2:
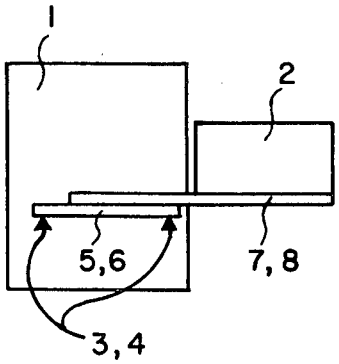
PRIOR ART Fig. 2
FIG. 2 schematically shows the outline of the sensitive member support means of the present invention.

To solve the previously-described problems, the present invention generally provides a belt module comprising, see FIG. 2, triple-section guide rails consisting of pairs of rails 5 and 6 rigidly supported at points 3 and 4 within the main body 1 of a reproducing apparatus; two pairs of rails 7 and 8 provided outwardly of the periphery of belt module 2 and slidably fitted in or engaged with the aforesaid pairs of rails 5 and 6 so as to mount module 2 slidably with respect to the aforesaid rails 5 and 6; and reinforcing rails (not visible in FIG. 2) inserted between the first-mentioned pairs of rails 5 and 6 and the second-mentioned pairs of rails 7 and 8. The aforesaid reinforcing rails are adapted to be slid to a given position on the pairs of rails 5 and 6, following the movement of module 2 when this last is withdrawn from main body 1 of the reproducing apparatus, such that the reinforcing rails may support the load of a heavy module 2 with the load uniformly applied to the triple-section rail guides. Thus, there is no risk that an excessive load would be exerted on a single pair of rails alone. Module 2 is so constructed (see FIG. 3) that when in the position withdrawn out of main body 1 of the reproducing apparatus, the module can be rotated about hinges 25,25' towards an operator (clockwise direction in FIG. 3) to provide an opening between the unit itself and the support rails, whereby the belt may be replaced with ease by releasing the roller which holds it in tension. In the event that the surface of the belt is stained due to adherence of toner or dust, or a sheet of copy paper is stuck in the reproducing apparatus, then cleaning of the belt surface or removal of the jammed copy paper from the apparatus is possible with module 2 maintained in the position withdrawn out of main body 1 of the reproducing apparatus. According to the present invention, since module 2 is slidably supported on a pair of rails 5 and 6, each rigidly supported at two points, all rails are free from deflection even after frequent and repeated operations withdrawing and reinserting module 2 from and into main body 1 of the reproducing apparatus. In addition, the aforesaid rails supported at two points do not interfere with replacement of a belt on module 2, such replacement being readily accomplished.

Figure 3:
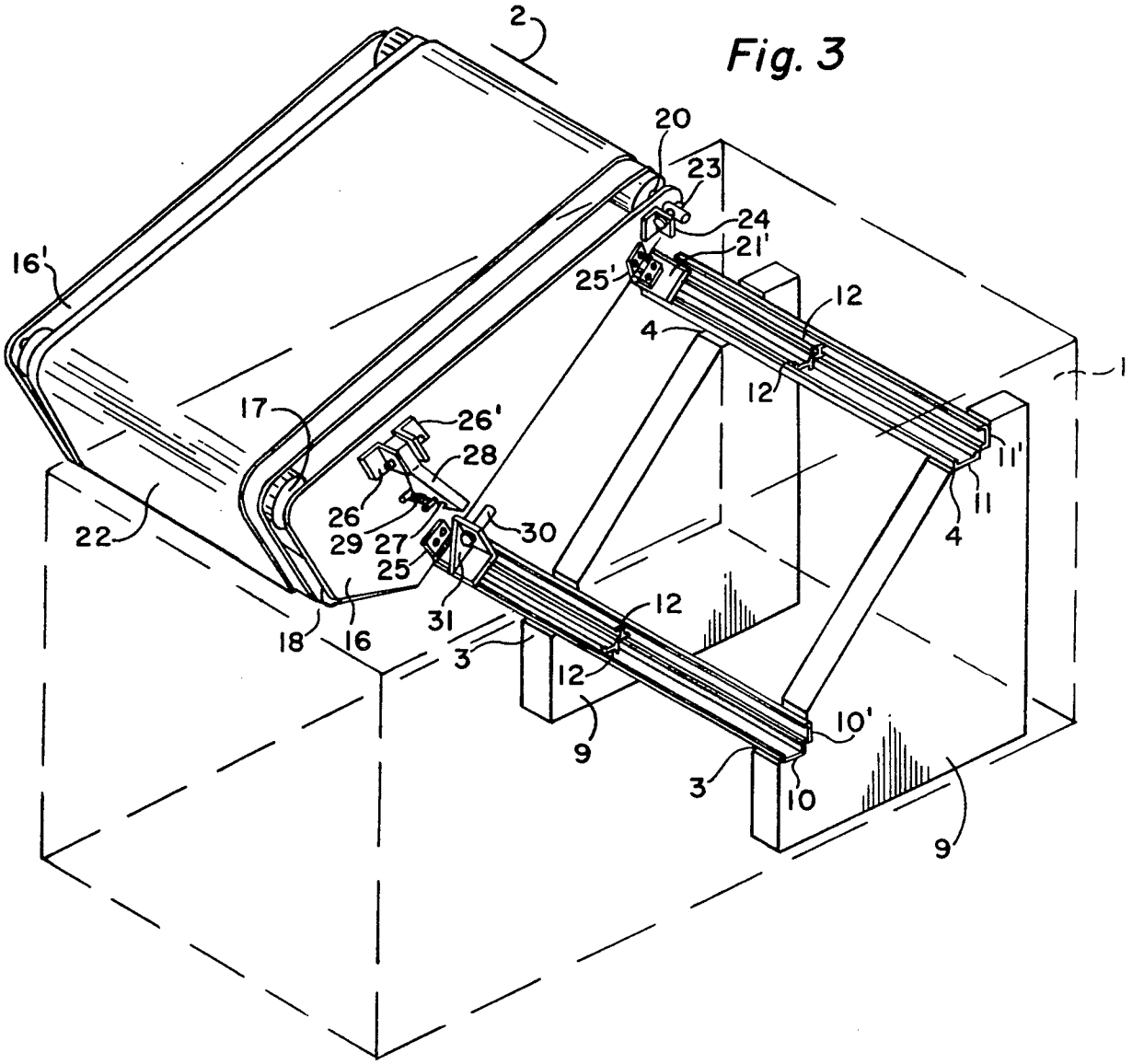
FIG. 3 is a perspective view showing the state of the sensitive member unit after being withdrawn from the main body of the reproducing apparatus.
Figure 4:
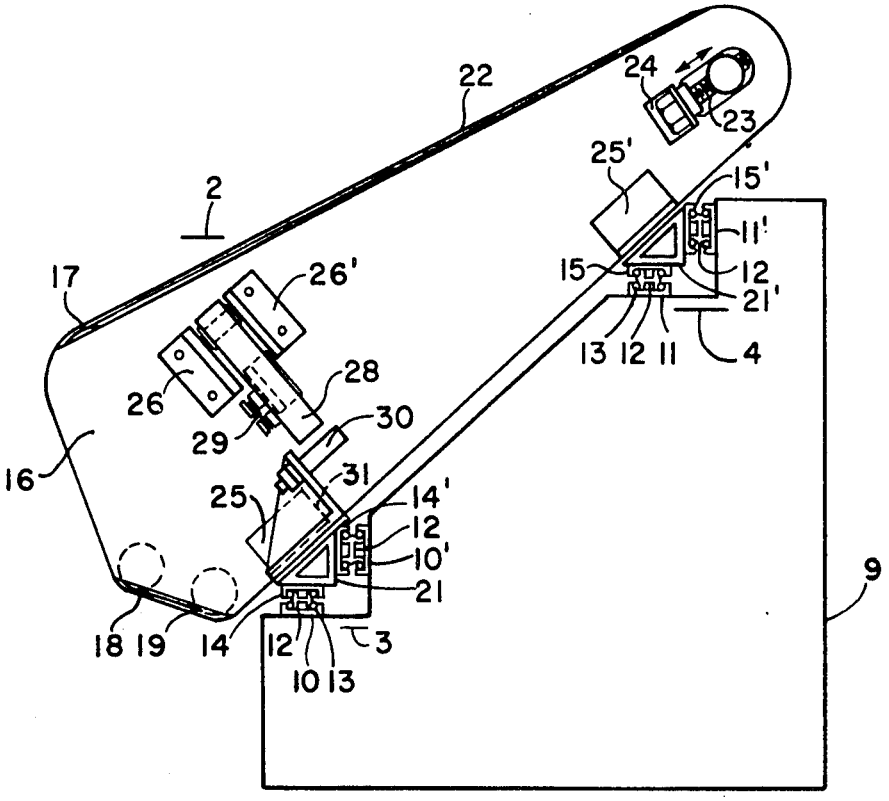
FIG. 4 is a cross-sectional view of the sensitive member unit of FIG. 3.
Figure 5:
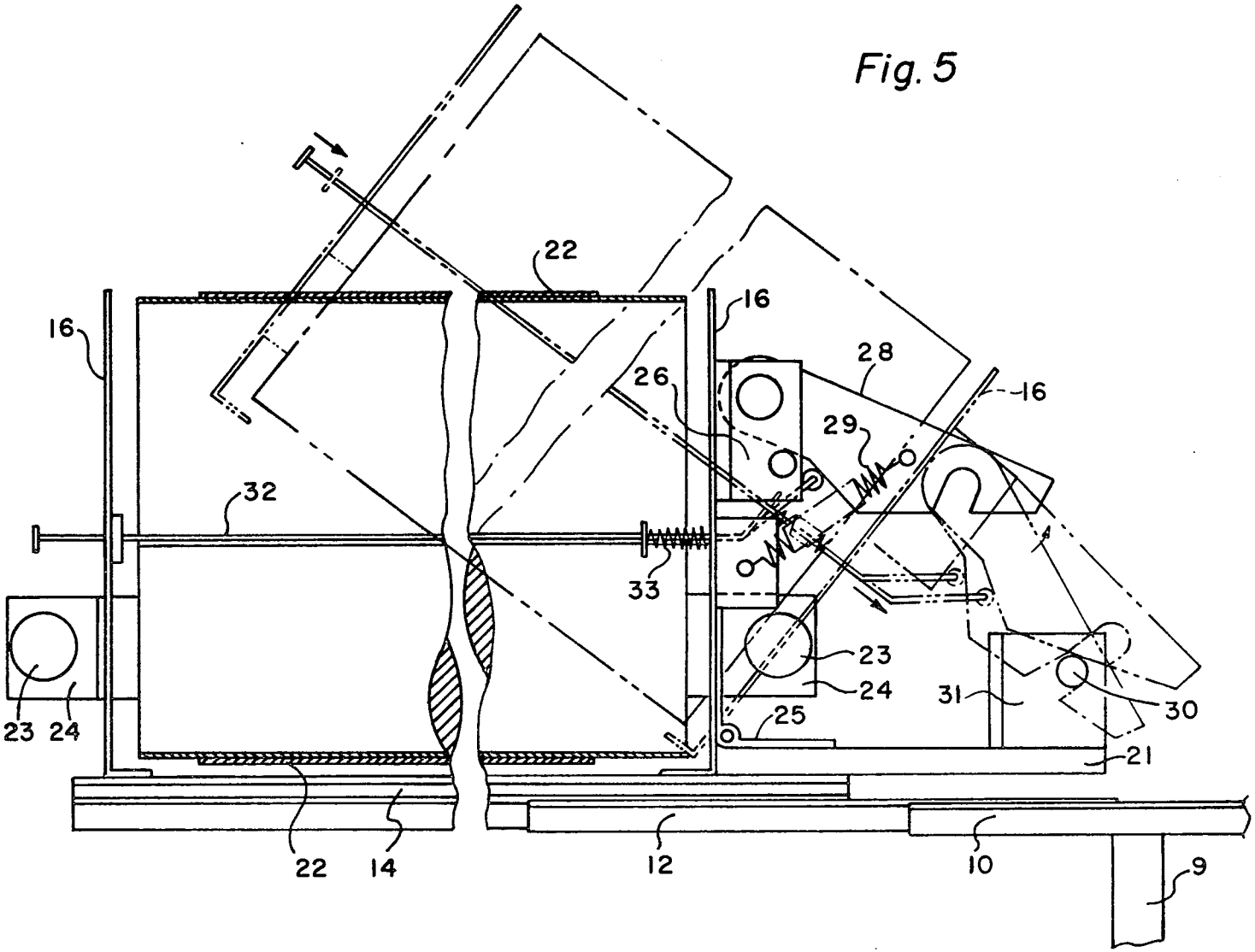
FIG. 5 is a cross-sectional view showing the sensitive member unit of FIG. 3 both at rest (solid lines) and also when in the open position (dotted lines).

A detailed description of the preferred embodiment of the present invention will be given below in conjunction with FIGS. 3 through 5.

Rail support members 9 provided within the main body 1 of a reproducing apparatus rigidly support two pairs of rails 10, 10' and 11, 11' mounted on main body 1 at points 3 and 4. The two pairs of rails 10, 10' and 11, 11' are positioned (see FIG. 4) in facing relation to another two pairs of rails 14,14' and 15, 15' which are fixedly mounted on the outer wall of module 2, with reinforcing rails 12 and a plurality of bearings 13 being interposed between the respective rail pairs, the reinforcing rails 12 being slidable together with module 2. Thus, triple-section rail guides in combination serve as a support for the unit. This is done for the sake of distributing the load of the heavy module 2 uniformly among those rails.

In detail, when module 2 is withdrawn from main body 1 of the reproducing apparatus with the reinforcing rails 12 inserted between the pairs of rails 10, 10' and 11, 11' provided on the main body 1 and the pairs of rails 14, 14' and 15, 15' of module 2, the extremely heavy module 2 may be maintained out of main body 1 for a long period of time, during which period cleaning of the belt surface or removal of a copy paper stuck in the main body is effected, without risk of an excessive load being inadvertently exerted on rails 10, 10' and 11, 11' and on the rails 14, 14' and 15, 15', since the reinforcing rails 12 inserted in respective pairs of these rails serve to distribute the load of the heavy module 2 so that it is shared by all the rails. When module 2 is withdrawn from main body 1, the reinforcing rails 12 in turn are slid along the respective rails 10, 10' and 11, 11' fixed on the main body and stop at a given position on those rails, whereby the load of module 2 is shared among the pairs of rails 10, 10' and 11, 11', and the pairs of rails 14, 14' and 15, 15', as stated above. When module 2 is pushed back into main body 1, the reinforcing rails 12 are also slidingly returned on the respective rails 10, 10' and 11, 11'.

Modular unit 2 is composed of a pair of opposing frames 16 and a plurality of rollers 17, 18, 19 and 20, one of which is a driving roller. The aforesaid pairs of rails 14, 14' and 15, 15' are fixed to rail-attaching members 21 and 21' projecting from the frames 16, thereby supporting the module 2 at rest, as well as permitting it to travel back and forth on the rails 10, 10' and 11, 11' by way of the rails 14, 14' and 15, 15'. A belt 22 is trained in tension about the aforesaid plurality of rollers 17, 18, 19 and 20. An adjusting member 23, such as a jack screw, is threaded radially into the shaft of roller 20 near the end of the shaft. The adjusting member 23 is anchored with respect to the directions of the double-headed arrow in FIG. 4 by means of a screw-support member 24 attached to frame 16, for purposes of providing the tension in belt 22. If adjusting member 23 is turned to move shaft 20 toward the screw-support member 24 (i.e., the leftward direction of the arrow in FIG. 4), then belt 22 will be demountable from module 2. Although in this embodiment a screw is provided for purposes of replacing a used belt by a new one or for tensioning the belt, the adjusting means are not limited to a screw since spring tension may be utilized for tightening or for permitting replacement of belt 22. Modular unit 2, as set forth, is adapted to be pivotally moved in a manner to provide an opening between the unit itself and the pairs of rails 14, 14' and 15, 15', after withdrawal from main body 1. In this embodiment, module 2 is coupled to main body 1 by hinges 25 and 25' between the rail mounts 21, 21' and the unit frame 16.

For retaining or locking module 2 in the position providing an opening between it and the rails 14, 14' and 15, 15' for a long period of time during which replacement of belt 22 trained about the plurality of rollers can be effected, there is provided between rail mounts 21, 21' and unit frame 16, a mechanism for locking module 2 in open position. As shown in FIGS. 3 through 5, an arm 28 is pivotally mounted between brackets 26 and 26', which have an L-shape in cross section and are rigidly fastened to unit frame 16. Arm 28 has a pin-engaging cut-away portion 27 near its free end and is normally urged towards frame 16, i.e., in the clockwise direction in FIG. 3. A pin 30 is mounted on a pin support member 31 which in turn is affixed to one end of rail mount 21, so as to fit in the pin-engaging cut-away portion 27 of the above-mentioned arm. Pin 30 and arm 28 are located in spaced relation to each other in a manner to provide a given opening for module 2 with respect to the rails 14, 14' and 15, 15' when the pin and arm are engaged. FIG. 5 illustrates the pivotal movement of modular unit 2 with respect to main body 1. If module 2 is moved from rest in a direction to create an opening between same and the rails 14, 14' and 15, 15', as shown in FIG. 5, the free end of arm 28 will come to bear on pin 30 against the action of a spring 29. When cut-away portion 27 of arm 28 comes into engagement with pin 30, module 2 will be locked in a position to provide an opening between same and rails 14, 14' and 15, 15'.

A shaft 32 passing through module 2 in the transverse direction thereof (see FIG. 5) is held by the frames 16 and has one end which engages the lower face of arm 28 in a manner to normally urge the arm upwardly. Shaft 32 is urged in the leftward direction in FIG. 5 under the action of a coil spring 33. If shaft 32 is manually urged in the direction of the arrow shown adjacent the open — i.e., dotted line — position in FIG. 5, arm 28 is raised up, thereby releasing module 2 from locked position.

The modular unit 2 thus constructed and having the belt 22 trained in tension therearound is actuatable by the driving roller when the unit is returned into main body 1, so as to permit effecting reproduction of an original image. When there arises the necessity of cleaning belt 22, removing a copy paper stuck in main body 1 or replacing a belt 22, actuation of module 2 is stopped and it is then withdrawn from main body 1 towards an operator (in the leftward direction in FIG. 3), whereby a copy paper stuck in main body 1 can be removed or cleaning the surface of belt 22 accomplished by rotating the belt by means of a manual drive wheel (not shown), module 2 meanwhile being maintained in the withdrawn position. For replacing a used belt 22 by a new one, modular unit 2 is withdrawn from main body 1 and urged in the clockwise direction (FIG. 3) about the hinges 25 and 25', to thereby provide a wide opening between the unit and rails 14, 14' and 15, 15'. After arm 28 mounted on unit 2 has been locked by pin 30, the screw 23 passing through the end of roller shaft 20 (as shown in FIG. 4) is manipulated to move the shaft in the leftward direction of the arrow in FIG. 4, thereby relieving tension on belt 22, whereby the used belt 22 can be taken away from the unit and replaced by a new one. At completion of belt replacement, screw 23 is manipulated in the counter-direction to exert tension on the fresh belt 22. For reinserting module 2 in main body 1, shaft 32 shown in FIG. 5 is manually urged rightward against the force of spring 33 so as to release arm 28 from engagement with pin 30. Then, module 2, while resting on rails 14, 14' and 15, 15', is manually urged toward main body 1, thereby being returned to its home position.

According to the present invention, there are provided triple-section rail guides in combination, which consist of pairs of rails 10, 10' and 11, 11' fixed on support members 9 at points 3 and 4 provided within main body 1, reinforcing rails 12 and pairs of rails 14, 14' and 15, 15' mounted on the outer wall of module 2. The latter pairs of rails are in facing relation to the former pairs of rails by way of the reinforcing rails 12. In particular, when module 2 is withdrawn from main body 1 and allowed to stand on the extended rails for a long period of time, the load of the extremely heavy modular unit 2 is distributed by the reinforcing members so as to be uniformly applied to respective rails of the triple-section rail guides, without concentration of such a heavy load on one pair of rails only. Thus, the respective rails are maintained free from the deflection experienced with the conventional rails supported at one side, without provision of a particularly strong reinforcing member for supporting such rails. Furthermore, since module 2 is pivotally movable on the rails 14, 14' and 15, 15' to afford selective opening between same and main body 1, these pairs of rails on unit 2 do not interfere with replacement of a belt 22.

What is claimed is:

1. In a belt-type photosensitive member unit for use in an electrophotographic reproducing apparatus having a main body portion, the unit normally being located in an operative position internal to the main body and including a plurality of rollers rotatably confined within a framework, a belt-type sensitive member being trained about said plurality of rollers, and said rollers comprising a drive roller, the improvement in said unit comprising:

first guide means rigidly secured at two points along the length thereof to the main body of the reproducing apparatus;

second guide means attached to said sensitive member unit outwardly thereof and adapted to cooperate telescopically with said first guide means to permit displacement of said sensitive member unit to a position external to the main body; and means pivotally mounting said unit to said second guide means whereby the unit can be pivoted away from the second guide means to provide an opening for access to said belt-type sensitive member with the unit in said external position.

2. A unit as defined in claim 1, further including a mechanism for locking said sensitive member unit in the open position when the unit has been pivotally moved to provide an opening between same and said second guide means provided on the unit.

3. A unit as defined in claim 2, wherein said locking mechanism comprises an arm adapted to engage a pin affixed to a discrete one of said second guide means.

4. A unit as defined in claim 3, further including a shaft transversely passing through said sensitive member unit and movably supported therein, together with means resiliently urging the shaft to a normal position of rest, the shaft contacting said arm when in the normal position and cooperating with the arm to release it from said pin when the shaft is manually moved to a second position remote from the rest position.

5. A photosensitive member unit as defined in claim 1, wherein said first and second guide means comprise at least a first pair of spaced guide rails in cooperating engagement with a second pair of spaced guide rails.

6. A photosensitive member unit as defined in claim 5, wherein reinforcing rails are disposed between cooperating ones of said first pair and said second pair of guide rails in a manner to be movable to given positions on said first pair of rails together with said sensitive member unit when same is withdrawn from and returned into the interior of the reproducing apparatus.

7. A unit as defined in claim 6, wherein the pairs of rails comprise at least one horizontal rail and one vertical rail affixed to said sensitive member unit, and at least one horizontal rail and one vertical rail in respective facing relation thereto and affixed to said support members, the facing rails defining a raceway, said reinforcing rails being located in said raceway intermediate the facing rails, but spaced therefrom, and a plurality of bearings located in the spaces between the reinforcing rails and the facing rails, thereby providing rigid horizontal and vertical support for the sensitive member unit combined with easy lateral displacement at the will of the operator.

8. A unit as defined in claim 7, further including a mechanism for locking said sensitive member unit in the open position when the unit has been pivotally moved to provide an opening between same and said second-mentioned pairs of rails provided on the unit.

9. A unit as defined in claim 8, wherein said locking mechanism comprises an arm adapted to engage a pin affixed to a discrete one of said second-mentioned pairs of rails.

10. A unit as defined in claim 9, further including a shaft transversely passing through said sensitive member unit and movably supported therein, together with means resiliently urging the shaft to a normal position of rest, the shaft contacting said arm when in the normal position and cooperating with the arm to release it from said pin when the shaft is manually moved to a second position remote from the rest position.

11. An electrophotographic reproducing apparatus having a main body portion; a belt-type photosensitive member unit normally located in an operative position internal to the main body and including a framework and a plurality of rollers rotatably confined within the framework, a belt-type sensitive member being trained about said plurality of rollers and said rollers comprising a drive roller, said unit comprising:

first guide means rigidly secured at two points along the length thereof to the main body of the reproducing apparatus; and second guide means attached to said sensitive member unit outwardly thereof and adapted to cooperate telescopically with said first guide means to permit displacement of said sensitive member unit to a position external to the main body.

* * * * *